US011105304B2

(12) United States Patent
Kim et al.

(10) Patent No.: US 11,105,304 B2
(45) Date of Patent: Aug. 31, 2021

(54) FUEL INJECTOR HAVING RESIDUALLY STRESSED SOLENOID HOUSING FOR IMPROVED PRESSURE CAPAPILITY

(71) Applicant: Caterpillar Inc., Deerfield, IL (US)

(72) Inventors: Hoisan Kim, Dunlap, IL (US); Victor Iskander Yacoub, Washington, IL (US); Sridhar Thangaswamy, Dunlap, IL (US); Cory Brown, Peoria, IL (US); Robert Joseph Smith, Pontiac, IL (US)

(73) Assignee: Caterpillar Inc., Peoria, IL (US)

( * ) Notice: Subject to any disclaimer, the term of this patent is extended or adjusted under 35 U.S.C. 154(b) by 125 days.

(21) Appl. No.: 16/209,058

(22) Filed: Dec. 4, 2018

(65) Prior Publication Data

US 2020/0173408 A1 Jun. 4, 2020

(51) Int. Cl.

| | |
|---|---|
| ***F02M 47/00*** | (2006.01) |
| ***F02M 47/02*** | (2006.01) |
| ***F02M 57/02*** | (2006.01) |
| *F02M 63/00* | (2006.01) |
| *F02M 61/16* | (2006.01) |

(52) U.S. Cl.

CPC ..... *F02M 47/027* (2013.01); *F02M 57/023* (2013.01); *F02M 61/168* (2013.01); *F02M 63/0015* (2013.01); *F02M 63/0059* (2013.01); *F02M 2200/40* (2013.01); *F02M 2200/8069* (2013.01)

(58) Field of Classification Search

CPC ..... F02M 63/0015; F02M 63/0059; F02M 63/0007; F02M 63/0026; F02M 47/027; F02M 2200/8069; F02M 2200/40; F02M 61/168; F02M 51/061; F02M 2700/072

See application file for complete search history.

(56) References Cited

U.S. PATENT DOCUMENTS 5,241,935 A * 9/1993 Beck ..... F02M 61/06 123/300
5,467,754 A * 11/1995 Beck ..... F02M 61/06 123/467
5,494,219 A 2/1996 Caterpillar
(Continued)

FOREIGN PATENT DOCUMENTS

DE 102009028262 A1 2/2011
DE 102011004196 A1 8/2012
(Continued)

OTHER PUBLICATIONS

GB IPO, Search Report for GB 1917637.9. Not yet published in Great Britain. Entire Document.

*Primary Examiner* — Phutthiwat Wongwian
*Assistant Examiner* — Sherman D Manley

(57) ABSTRACT

A fuel injector includes an injector body, and a stack within the injector body, and having a nozzle supply passage therein. The stack includes a solenoid assembly having a solenoid housing piece with a fuel bore formed therein that includes a segment of the nozzle supply passage. The solenoid housing piece includes a solenoid housing material in a base state, and a solenoid housing material in a residual compressive stressed state, with the fuel bore being formed by the solenoid housing material in the residual compressive stressed state. Residual stresses may be imparted by ballizing, nitriding, carburizing, autofrettage, or still another technique.

13 Claims, 4 Drawing Sheets

(56) References Cited

U.S. PATENT DOCUMENTS

| | | | | |
|---|---|---|---|---|
| 5,537,972 | A * | 7/1996 | Beck | F02M 47/02 123/198 D |
| 6,543,424 | B1 * | 4/2003 | Yamaguchi | C23C 28/048 123/495 |
| 8,474,438 | B2 * | 7/2013 | Kondo | G01L 23/18 123/494 |
| 2004/0021013 | A1 * | 2/2004 | Lawrence | F02M 61/182 239/533.12 |
| 2005/0000077 | A1 * | 1/2005 | Dvoskin | G01B 5/12 29/407.08 |
| 2007/0079675 | A1 | 4/2007 | Kronberger | |
| 2009/0026292 | A1 | 1/2009 | Caterpillar | |
| 2009/0113707 | A1 | 5/2009 | Kosiorek et al. | |
| 2010/0276520 | A1 * | 11/2010 | Lewis | F02M 61/18 239/589 |
| 2012/0285417 | A1 * | 11/2012 | Kim | F02D 19/10 123/299 |
| 2013/0160741 | A1 * | 6/2013 | Sommars | F02D 19/0694 123/456 |
| 2014/0311455 | A1 * | 10/2014 | Kim | F02D 19/10 123/472 |
| 2016/0069312 | A1 * | 3/2016 | Brown | H01F 7/1607 239/585.5 |
| 2016/0258401 | A1 * | 9/2016 | Kim | F02M 63/0021 |
| 2016/0290302 | A1 * | 10/2016 | Shafer | B33Y 80/00 |
| 2016/0305382 | A1 * | 10/2016 | Kim | F02M 61/12 |

FOREIGN PATENT DOCUMENTS

| | | | |
|---|---|---|---|
| EP | 2789409 | A1 | 10/2014 |
| IE | 102011004196 | A1 | 8/2012 |

* cited by examiner

FUEL INJECTOR HAVING RESIDUALLY STRESSED SOLENOID HOUSING FOR IMPROVED PRESSURE CAPAPILITY

TECHNICAL FIELD

The present disclosure relates generally to an electrical actuator solenoid assembly of a type used in a fuel injector, and more particularly to a solenoid housing piece having a fuel bore formed by solenoid housing material in a residual compressive stressed state.

BACKGROUND

Modern fuel systems used in internal combustion engines are of many different designs. In a system employing direct fuel injection, as in many compression ignition diesel engines, a plurality of fuel injectors are associated with and extend into a plurality of combustion cylinders in an engine housing. Pressurized fuel is injected directly into the cylinder at a desired engine timing to initiate combustion, driving a piston to rotate a crankshaft in a generally well-known manner. Fuel pressurization for injection in such systems can take place within each fuel injector, in a separate unit pump associated with each fuel injector, or by way of a relatively large volume of fuel in a so-called common rail or the like that is maintained at a desired pressure with a single high-pressure pump. Other variations where one pump is used to pressurize fuel for two or three fuel injectors, where multiple common rails are each maintained at different fuel pressures, and still others are also known.

It has been observed for decades that relatively higher fuel injection pressures can promote greater fuel atomization that in turn is associated with more complete burning of an injected charge of fuel, and thus reduce levels of certain undesired emissions. Systems are known which pressurize fuel for injection to in excess of 125 megapascals (MPa), and in some instances greater than 150 MPa. Such high fuel pressures can necessitate robust equipment to produce the fuel pressure and maintain it within or between various components. Relatively high fuel pressures can also be desirable from the standpoint of engine power density.

Available engine power output for an engine of a given size tends to relate to a number of factors including an amount of fuel that can be combusted with air per engine cycle. For this reason relatively high fuel injection pressures can be desirable for optimal power density as it becomes possible to deliver more fuel for combustion in the relatively short amount of time available in a typical engine cycle. It is common for a liquid fuel charge in a compression ignition diesel engine to desirably be injected within about 50 degrees of crank angle, and often less. Even at relatively lower engine speeds and loads injecting a sufficient quantity of fuel can be challenging, whereas for relatively higher engine speeds, and loads quite rapid actuation of components and management of high fuel pressures can necessitate specialized equipment, manufacturing techniques and sophisticated controls to achieve a desired or optimum power density for the engine in a practical engine design. U.S. Patent Application Publication No. 2016/0290302 proposes a fuel injector that is apparently treated by techniques to improve its robustness.

SUMMARY OF THE INVENTION

In one aspect, a fuel injector includes an injector body defining a longitudinal axis and having each of a fuel inlet and a low pressure outlet formed therein. A stack is positioned at least partially within the injector body and has each of a control chamber and a nozzle supply passage formed therein, the stack including a solenoid assembly and a tip piece having a plurality of nozzle outlets formed therein. The fuel injector further includes an outlet check having a closing hydraulic surface exposed to the control chamber and adjustable between an open check position and a closed check position to open and close, respectively, the plurality of nozzle outlets. The solenoid assembly includes a solenoid housing piece having a fuel bore formed therein that includes a segment of the nozzle supply passage. The solenoid housing piece includes a solenoid housing material in a base state, and a solenoid housing material in a residual compressive stressed state, and the fuel bore is formed by the solenoid housing material in the residual compressive stressed state.

In another aspect, a method of making a fuel injector includes compressing solenoid housing material forming a fuel bore in a solenoid housing piece, and inducing residual compressive stress in the solenoid housing material forming the fuel bore, in response to the compression of the solenoid housing material. The method further includes installing the solenoid housing piece in a stack in a fuel injector, and orienting the solenoid housing piece in the stack such that the fuel bore forms a segment of a nozzle supply passage for feeding a pressurized fuel to a plurality of nozzle outlets in a tip piece of the fuel injector.

In still another aspect, a fuel system includes a plurality of fuel injectors each having a tip piece with a plurality of nozzle outlets formed therein. Each of the plurality of fuel injectors further include a control valve assembly, and a solenoid assembly coupled with the control valve assembly. The solenoid assembly includes a solenoid housing piece having a fuel bore formed therein for supplying a pressurized fuel to the corresponding plurality of nozzle outlets. The solenoid housing piece includes a solenoid housing material in a base state, and a solenoid housing material in a residual compressive stressed state, and the fuel bore is formed by the solenoid housing material in the residual compressive stressed state.

DETAILED DESCRIPTION

Figure 1:
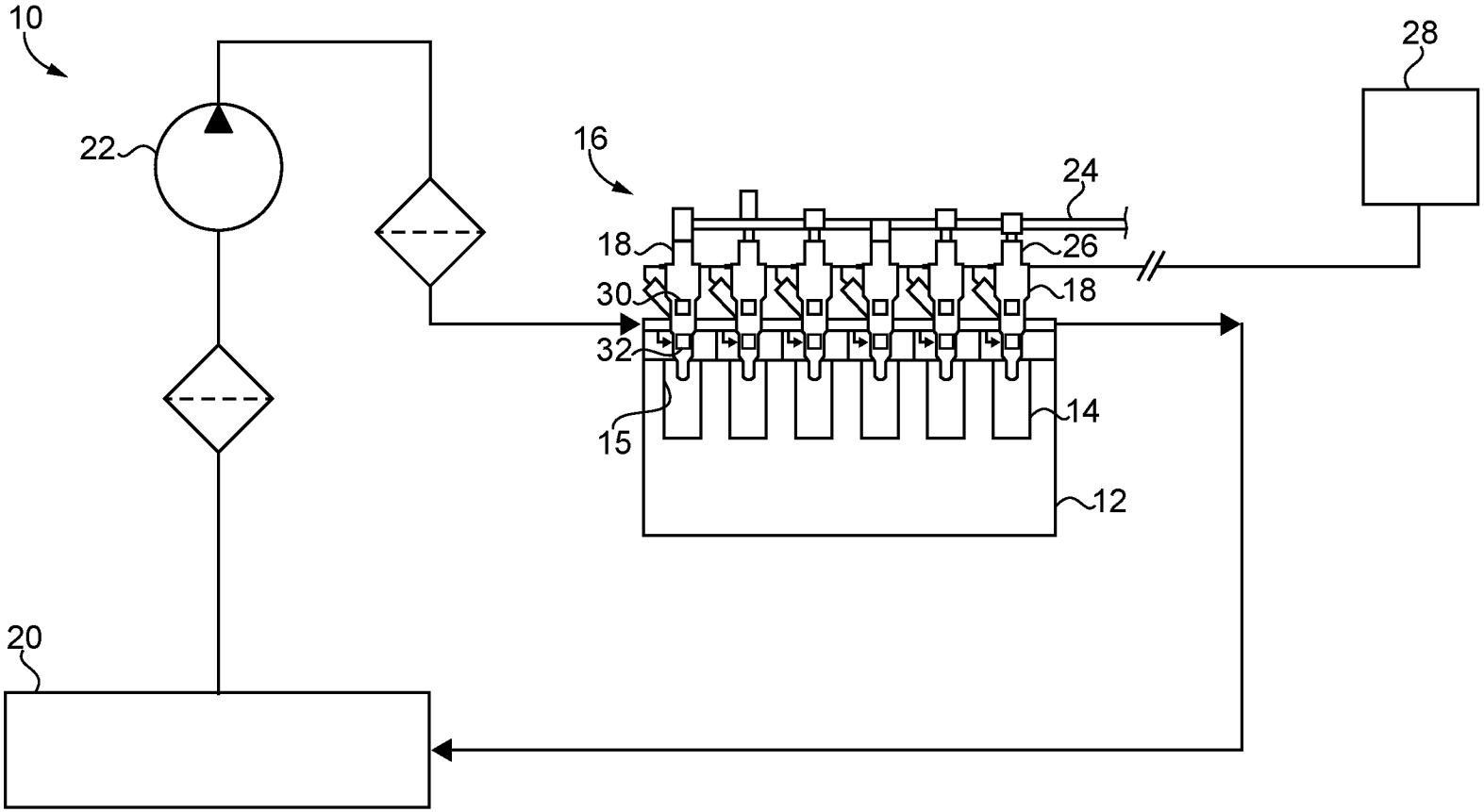
FIG. 1 is a schematic view of an engine system, according to one embodiment.

Referring to FIG. 1, there is shown an engine system 10 according to one embodiment and including an internal combustion engine 12 having an engine housing 14 with a plurality of cylinders 15 formed therein. Although not pictured, it will be appreciated that a plurality of pistons are positioned one within each of the plurality of cylinders 15 and structured to reciprocate to rotate a crankshaft in a generally conventional manner. Engine system 10 can include a compression ignition diesel engine system structured to operate on a diesel distillate fuel, biodiesel, blends of these, or still others. Cylinders 15 can be arranged in any suitable configuration such as a V-configuration, an in-line configuration, or still another. Engine system 10 further includes a fuel system 16 structured to supply a pressurized fuel to a plurality of fuel injectors 18 each positioned at least partially within one of cylinders 15. Fuel system 16 further includes a fuel supply 20 and a fuel transfer pump 22 structured to supply fuel from fuel supply 20 to fuel injectors 18. Fuel system 16 also includes a camshaft 24 rotatable by way of an engine flywheel (not shown), and typically rotated at one half engine speed in a conventional four-cycle operating strategy. Camshaft 24 is structured to rotate in contact with a plurality of tappets 26 each associated with one of fuel injectors 18. Each fuel injector 18 further includes an injection control valve assembly 32 and a solenoid assembly 30. An electronic control unit or ECU 28 is provided to energize and control the various electrical operations of fuel system 16 including energizing and deenergizing solenoid assemblies 30 to operate control valve assemblies 32 for controlling fuel injection as further discussed herein. As will be further apparent from the following description, fuel system 16 is uniquely structured by way of solenoid assemblies 30 to accommodate relatively high fuel pressures that assist in attaining optimal power density of engine system 10.

Figure 2:
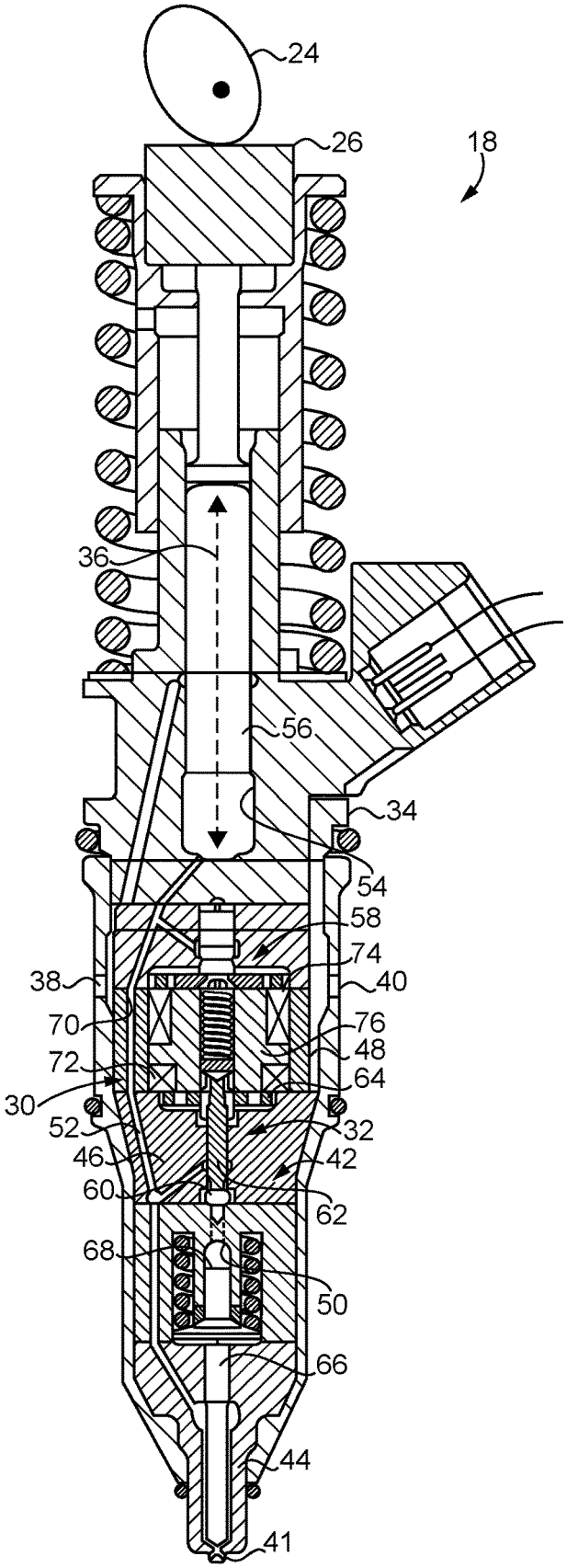
FIG. 2 is a sectioned side diagrammatic view of a fuel injector, in a fuel system according to one embodiment.

Referring now also to FIG. 2, there is shown a fuel injector 18 as might be used in fuel system 16 and engine system 10. Fuel injector 18 is discussed herein in the singular, however, it will be appreciated that such description applies by way of analogy to any of the other fuel injectors 18 in fuel system 16, as they may all be substantially identical. Fuel injector 18 includes an injector body 34 defining a longitudinal axis 36 and having each of a fuel inlet 38 and a low pressure outlet 40 formed therein. Fuel inlet 38 may be structured to fluidly connect with a fuel supply conduit within an engine head of engine housing 14, with low pressure outlet 40 analogously structured to fluidly connect with the same fuel conduit or a separate drain conduit that conveys fuel back to fuel supply 20, again in a generally known manner. Fuel injector 18 further includes a stack 42 positioned at least partially within injector body 34, stack 42 having each of a control chamber 50 and a nozzle supply passage 52 formed therein. In the illustrated embodiment stack 42 includes a tip or tip piece 44 having a plurality of nozzle outlets 41 formed therein that can fluidly connect to nozzle supply passage 52. Stack 42 also includes a valve housing piece 46 of control valve assembly 32 and a solenoid housing piece 48 of solenoid assembly 30. As noted above, fuel injector 18 can pressurize fuel in a mechanically actuated manner, with tappet 26 moving up and down relative to injector body 34 generally along longitudinal axis 36 in response to rotation of cam 24. A fuel pressurization plunger 56 is movable within a fuel pressurization chamber 54 formed in stack 42 that is in fluid communication with nozzle supply passage 52. Plunger 56 is movable between an advanced position and a retracted position, and coupled with tappet 26 in a generally conventional manner. In the illustrated embodiment control valve assembly 32 includes a valve member 60 and a rod 62 in contact with valve member 60. Valve member 60 could be a ball valve, a partially spherical valve, a disc, or some other type of valve. Control valve assembly 32 also includes an armature 64 coupled with rod 62 and movable between a first armature position and a second armature position to adjust control valve assembly 32 between an open valve position and a closed valve position, respectively. Fuel injector 18 may further include a spill valve assembly 58.

As noted above, stack 42 has control chamber 50 formed therein. When control valve assembly 32, namely valve member 60, is at an open valve position control chamber 50 is fluidly connected with low pressure outlet 40. When control valve assembly 32, namely valve member 60, is at the closed valve position control chamber 50 is disconnected with low pressure outlet 40 and connected with nozzle passage 52. Fuel injector 18 also includes an outlet check 66 having a closing hydraulic surface 68 exposed to control chamber 50 and adjustable between an open check position and a closed check position to open and close, respectively, nozzle outlets 41. Spill valve assembly 58 can also be adjustable between an open position at which reciprocation of plunger 56 can convey fuel from and to fuel inlet 38 or low pressure outlet 40, and a closed position where pressure in fuel pressurization chamber 54 is allowed to build in response to travel of plunger 56 to pressurize fuel for injection.

Solenoid assembly 30 further includes a solenoid housing piece 48 having a fuel bore 70 formed therein that includes a segment of nozzle supply passage 52. As further discussed herein solenoid housing piece 48 is formed such that fuel bore 70 can be made relatively large and is structured to withstand relatively high fuel pressures, thereby assisting in attaining optimal power density of engine system 10. In the illustrated embodiment solenoid assembly 30 includes a first solenoid coil 72 and a second solenoid coil 74 and a core 76. Armature 64 is adjusted between its first armature position and second armature position, respectively, in response to energizing and deenergizing solenoid coil 72, although a different change to an electrical energy state to actuate armature 64 could be used. Spill valve assembly 58 can be adjusted between its open and closed positions by way of energizing and deenergizing solenoid coil 74. One or more solenoid coils and a stator or core form a coil-and-stator subassembly as further described herein. Fuel injector 18 can include a bi-armature design. In other instances a single electrical actuator armature might be resident in a fuel injector.

Figure 3:
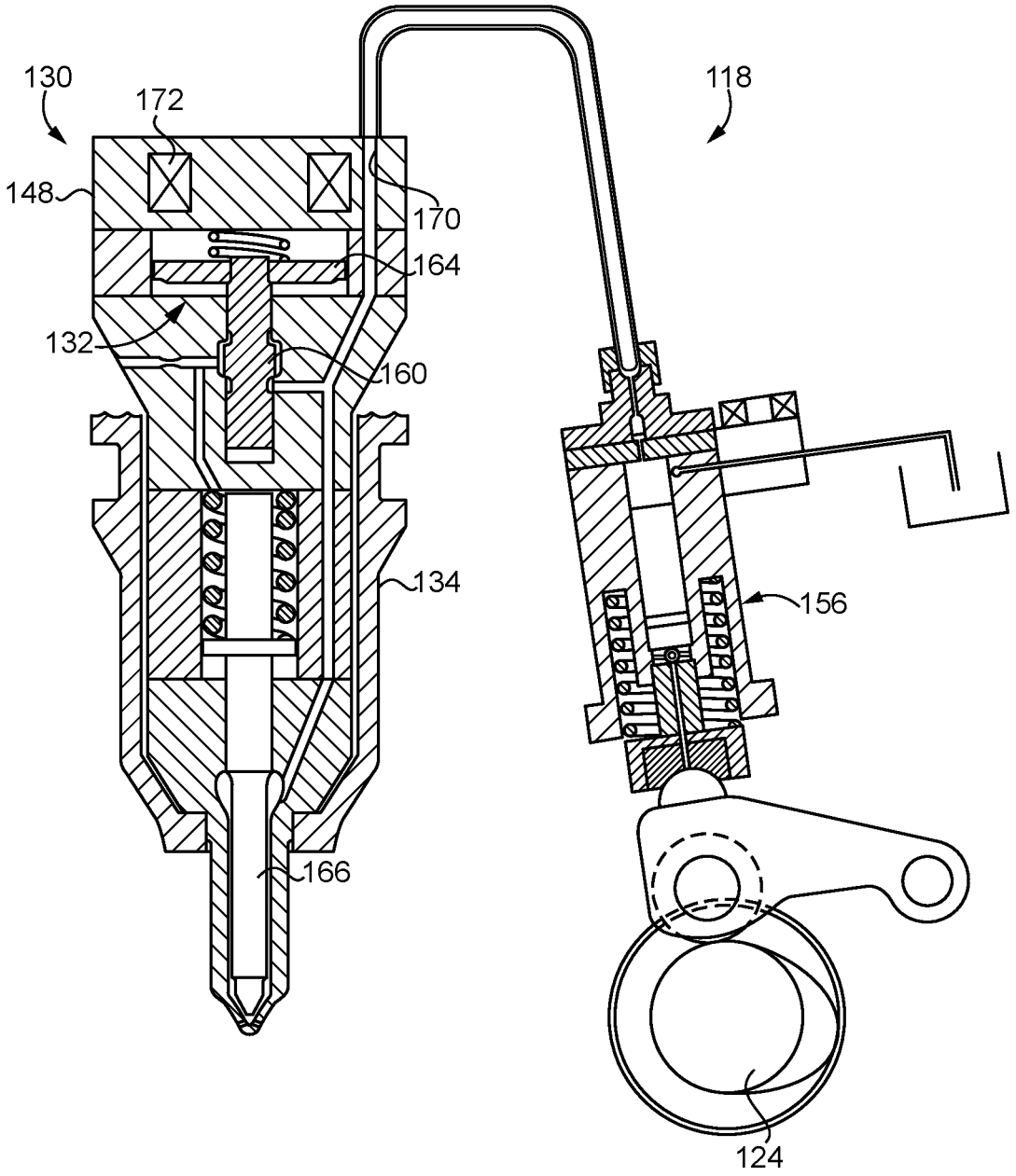
FIG. 3 is a sectioned side diagrammatic view of a fuel injector, in a fuel system according to another embodiment.

For example, referring now to FIG. 3 there is shown a fuel injector 118 according to another embodiment and including a fuel pressurization mechanism 156 that is outside of and separate from an injector body 134. Fuel pressurization mechanism 156 can operate in response to rotation of a cam 124. Fuel injector 118 also includes an outlet check 166, and an injection control valve assembly 132 having a valve member 160 and an armature 164. Injector body 134 and/or components therein form a nozzle supply passage 170 that extends through a solenoid assembly 130 having a solenoid housing piece 148 and a solenoid coil 172. It can be noted that in addition to separating fuel pressurization functions to a unit pump 156 or the like that is separate from fuel injector body 134, only a single armature 164 and single solenoid coil 172 are associated with injection control valve assembly 132 and solenoid assembly 130. Solenoid housing piece 148 can have a configuration generally analogous to solenoid housing piece 48, with a segment of nozzle supply passage 170 passing through solenoid housing piece 148, but utilizing a single solenoid coil 172. In still other embodiments, a solenoid assembly according to the present disclosure could be implemented in a common rail or analogously configured fuel system.

Figure 4:
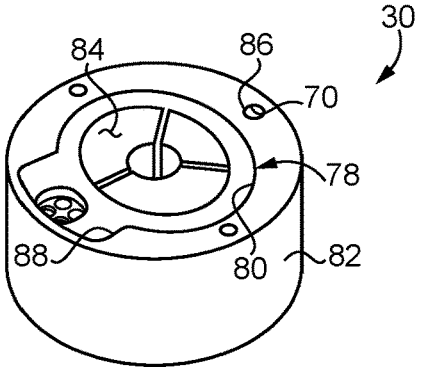
FIG. 4 is a diagrammatic view in perspective of a solenoid assembly, according to one embodiment.

Referring now to FIG. 4, there is shown solenoid assembly 30 illustrating additional features thereof. As suggested above solenoid assembly 30 can include a coil-and-stator subassembly, shown by way of reference numeral 78 in FIG. 4. Solenoid housing piece 48 further includes an outer housing surface 82, a first inner housing surface 80 forming a central bore 84 having coil-and-stator subassembly 78 positioned therein, and a second inner surface 86. Second inner surface 86 forms fuel bore 70 at a location that is radially outward of central bore 84. A cutout 88 is formed in first inner housing surface 80 to accommodate features of coil-and-stator subassembly 78. It can be noted that outer housing surface 82 has a cylindrical shape. First inner housing surface 80 also has a generally cylindrical shape, but interrupted by cutout 88. When solenoid assembly 30 is positioned for service in fuel injector 18, or another fuel injector according to the present disclosure, solenoid housing piece 48 can be clamped between adjacent components in stack 42. In the embodiment of FIG. 2 solenoid assembly 30, including solenoid housing piece 48, is clamped against adjacent valve housing piece 46, which in turn is clamped against one or more tip pieces 44. Additional stack components are clamped on top of solenoid assembly 30 to house the components for spill valve assembly 58 and plunger 56, et. cetera.

Figure 5:
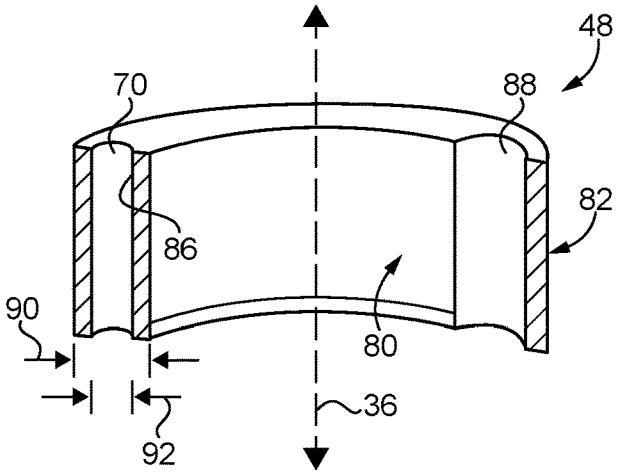
FIG. 5 is a sectioned view through a solenoid housing piece, according to one embodiment.

Referring also to FIG. 5, there is shown a sectioned view through solenoid housing piece 48 illustrating additional details. Longitudinal axis 36 of fuel injector 18 is shown extending through central bore 84. Central bore 84 may be centered on longitudinal axis 36, as may outer housing surface 82. Solenoid housing piece 48 has a radial thickness, along a radius of a circle centered on longitudinal axis 36, through fuel bore 70 and shown by way of reference numeral 90. Fuel bore 70 has a fuel bore diameter 92 that is about 50% of radial thickness 90, or greater. In some embodiments fuel bore diameter 92 might be from about 40% to about 60% of radial thickness 90, or potentially still greater. As used herein, the term "about" can be understood in the context of conventional rounding to a consistent number of significant digits. Accordingly, "about 50" means from 45 to 54, and so on.

As noted above, relatively higher fuel pressures can enable delivery of a relatively greater amount of fuel in a given time. Attaining an optimized power density can include not only increasing fuel pressure but also increasing a steady flow state of a fuel injector, in other words, designing fuel injector 18, 118 for a relatively greater steady flow of fuel compared to another fuel injector with other factors equal. According to the present disclosure, fuel bore diameter 92 may be relatively larger as a proportion of wall thickness 90 in comparison with other known designs to obtain a relatively greater steady flow. The increased fuel bore diameter and higher fuel pressures could be otherwise expected to result in less than optimal structural integrity of solenoid housing piece 48, due to thinning of the walls surrounding fuel bore 70. As alluded to above, however, the present disclosure addresses this issue by way of imparting residual compressive stresses to material of solenoid housing piece 48 so as to increase its resistance to fracture or other phenomena that can lead to performance degradation.

Industrial Applicability

Figure 6:
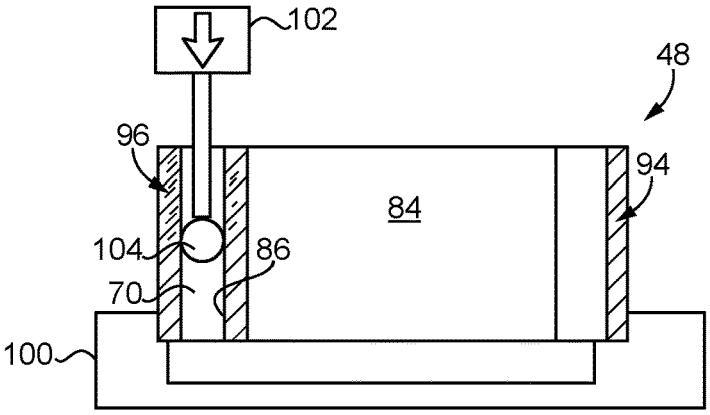
FIG. 6 is a diagrammatic view at one stage of making a fuel injector, according to one embodiment.

Referring also now to FIG. 6, there is shown solenoid housing piece 48 as it might appear positioned within a fixture or base 100, at one process stage in making fuel injector 18. Making fuel injector 18 can include compressing solenoid housing material forming fuel bore 70 in solenoid housing piece 48, and in the illustrated embodiment shows an actuator 102 as it might appear advancing a ball 104 through fuel bore 70. It can be seen also from FIG. 6 that solenoid housing piece 48 includes solenoid housing material in a base state 94, and solenoid housing material in a residual compressive stressed state 96 where the residual compressive stress is induced in the solenoid housing material that forms fuel bore 70. Different sectioning identifies an example illustration of the different materials In other words, residual compressive stress can be induced in the material that forms fuel bore 70 in response to compression of the native solenoid housing material.

The illustrated technique of inducing residual compressive stress is known generally as "ballizing" of fuel bore 70, where ball 104 is slightly oversized and thus interference fitted within fuel bore 70 and actuator 102 is used to push ball 104 through and clear of fuel bore 70. In the FIG. 6 illustration it can be seen that solenoid housing material in the residual compressive stressed state 96 forms second inner surface 86 at a location above ball 104, whereas solenoid housing material in the base state forms second inner surface 86 and fuel bore 70 below ball 104. As ball 104 is pushed the rest of the way through fuel bore 70 it can be expected that the solenoid housing material in the residual compressive stressed state 96 will be produced along an entirety of a length and surface area formed by second inner surface 86. It can also be appreciated that solenoid housing material in the base state 94 may be pervasive within solenoid housing piece 48 apart from second inner surface 86. Pervasive means that all, or substantially all, such as more than 90%, of the solenoid housing material is in the base state. As such, the rest of solenoid housing piece 48 apart from second inner surface 86, and some depth of penetration of residual stress therein, is not affected by the technique used to impart residual compressive stresses. The base state could be a state substantially free of residual compressive stress, such as might be obtained upon machining or near net shaping solenoid housing piece 48. Detection of residual compressive stress might be possible by way of destructive or non-destructive testing, or by testing or by observation of fuel injector 18 in a service or simulated service environment.

While ballizing is one practical implementation strategy, a number of other techniques are known whereby residual compressive stresses can be imparted to solenoid housing material to increase its capability for handling fuel pressures, such as fuel pressures in excess of 150 MPa. Nitriding, carburizing, heat treating, autofrettage, or still other techniques might be employed. Ballizing and these other techniques can also be used to selectively treat only that part of solenoid housing piece 48 which is desired to be transformed. Solenoid housing piece 48 may be a relatively soft iron such that the solenoid housing material can optimally assist in electromagnetic operation of control valve assembly 62 while still being structurally sound enough for other functions and for clamping within stack 42, without disturbance to material or magnetic properties that might be expected with other treatment techniques or structural designs. It should also be appreciated that valve housing piece 46 may be formed of a valve housing material that is different from the solenoid housing material, such as a relatively harder iron or steel material. After processing to induce residual compressive stress in the manner discussed herein, solenoid housing piece 48 may be coupled with coil-and-stator subassembly 78 by installing coil-and-stator sub assembly 78 in central bore 84, and solenoid assembly 30 and thus housing piece 48 installed in stack 42 in fuel injector 18. During installation of solenoid housing piece 48, solenoid housing piece 48 may be oriented in stack 42 such that fuel bore 70 forms a segment of nozzle supply passage 52, as discussed herein for feeding pressurized fuel to nozzle outlets 41 in tip piece 44. Orienting solenoid housing piece 48 as described can further include placing fuel bore 70 to fluidlly connect with fuel pressurization chamber 54.

The present description is for illustrative purposes only, and should not be construed to narrow the breadth of the present disclosure in any way. Thus, those skilled in the art will appreciate that various modifications might be made to the presently disclosed embodiments without departing from the full and fair scope and spirit of the present disclosure. Other aspects, features and advantages will be apparent upon an examination of the attached drawings and appended claims. As used herein, the articles "a" and "an" are intended to include one or more items, and may be used interchangeably with "one or more." Where only one item is intended, the term "one" or similar language is used. Also, as used herein, the terms "has," "have," "having," or the like are intended to be open-ended terms. Further, the phrase "based on" is intended to mean "based, at least in part, on" unless explicitly stated otherwise.

What is claimed is:

1. A fuel injector comprising:

an injector body defining a longitudinal axis and having each of a fuel inlet and a low pressure outlet formed therein;

a stack positioned at least partially within the injector body, the stack having each of a control chamber and a nozzle supply passage formed therein, and including a solenoid assembly and a tip piece having a plurality of nozzle outlets formed therein;

an outlet check having a closing hydraulic surface exposed to the control chamber and adjustable between an open check position and a closed check position to open and close, respectively, the plurality of nozzle outlets;

the solenoid assembly including a solenoid housing piece having a fuel bore formed therein that includes a segment of the nozzle supply passage;

the solenoid housing piece including a solenoid housing material in a base state, and a solenoid housing material in a residual compressive stressed state, and the solenoid housing material in the residual compressive stressed state forms an inner surface of the solenoid housing forming the fuel bore;

the stack further includes a valve housing piece formed of a valve housing material that is different from the solenoid housing material and positioned adjacent to the solenoid housing piece; and the solenoid housing material contains iron and the valve housing material contains iron, and the solenoid housing material is softer than the valve housing material.

2. The fuel injector of claim 1 wherein the solenoid assembly further includes a coil-and-stator subassembly, and the solenoid housing piece further includes an outer housing surface, a first inner housing surface forming a central bore having the coil-and-stator subassembly positioned therein, and a second inner surface that forms the fuel bore at a location that is radially outward of the central bore.

3. The fuel injector of claim 2 wherein the solenoid housing material in the base state is pervasive within the solenoid housing piece apart from the second inner surface.

4. The fuel injector of claim 2 wherein the solenoid housing piece has a radial thickness through the fuel bore, and the fuel bore has a fuel bore diameter that is about 50% of the radial thickness or greater.

5. The fuel injector of claim 2 wherein the stack further includes a fuel pressurization chamber formed therein that is fluidly connected with the nozzle supply passage.

6. The fuel injector of claim 5 further comprising a plunger movable within the fuel pressurization chamber between an advanced position and a retracted position, and a tappet coupled with the plunger.

7. The fuel injector of claim 2 further comprising a control valve assembly for the outlet check and including a valve member, a rod in contact with the valve member, and an armature coupled with the rod and movable between a first armature position and a second armature position to adjust the control valve assembly between an open valve position and a closed valve position, respectively, in response to energizing and deenergizing a solenoid of the coil-and-stator subassembly.

8. The fuel injector of claim 1 further comprising a plunger movable between a retracted position, where the fuel bore is exposed to a lower fuel pressure, and an advanced position, where the fuel bore is exposed to a higher fuel pressure, and the solenoid housing material in the residual compressive state is in the residual compressive stressed state when exposed to each of the lower fuel pressure and the higher fuel pressure.

9. A fuel system comprising:

a plurality of fuel injectors each including a tip piece having a plurality of nozzle outlets formed therein;

each of the plurality of fuel injectors further including a control valve assembly, and a solenoid assembly coupled with the control valve assembly;

the solenoid assembly including a solenoid housing piece having an inner housing surface defining a fuel bore for supplying a pressurized fuel to the corresponding plurality of nozzle outlets; and the solenoid housing piece including a solenoid housing material in a base state, and a solenoid housing material in a residual compressive stressed state;

the fuel bore being formed by the solenoid housing material in the residual compressive stressed state;

the fuel bore is ballized, such that the material in the residual compressive stressed stated is produced along an entirety of a length and a surface area of the inner housing surface; and the solenoid housing piece has a radial thickness through the fuel bore, and the fuel bore has a fuel bore diameter that is greater than 50% of the radial thickness.

10. The fuel system of claim 9 wherein each of the plurality of fuel injectors further includes a tappet and a plunger, and further comprising a camshaft structured to rotate in contact with each tappet.

11. The fuel system of claim 10 wherein each of the plurality of fuel injectors further includes an outlet check, and a control valve assembly for the corresponding outlet check having a valve housing piece positioned adjacent to the corresponding solenoid housing piece and including a valve housing material that is different from the solenoid housing material.

12. The fuel system of claim 11 wherein the solenoid housing material in the base state is pervasive within the solenoid housing apart from the solenoid housing material in the residual compressive stressed state.

13. The fuel system of claim 11 wherein the control valve assembly includes a valve member, a rod in contact with the valve member, and an armature coupled with the rod and movable between a first armature position and a second armature position to adjust the control valve assembly between an open valve position and a closed valve position.

* * * * *